United States Patent [19]

Spiller et al.

[11] Patent Number: 5,058,628

[45] Date of Patent: Oct. 22, 1991

[54] TERRY LOOM HAVING PROGRAMMABLE PILE FORMING ELEMENTS

[75] Inventors: Peter Spiller, Hinwill; Theo Thalmann, St. Gallen; Rudolf Vogel, Grut, all of Switzerland

[73] Assignee: Sulzer Brothers Limited, Winterthur, Switzerland

[21] Appl. No.: 377,717

[22] Filed: Jul. 10, 1989

[30] Foreign Application Priority Data

Jul. 8, 1988 [CH] Switzerland ..... 02622/88

[51] Int. Cl.[5] ..... D03D 49/10; D03D 39/22

[52] U.S. Cl. ..... 139/25; 139/26; 139/27; 139/102; 139/317

[58] Field of Search ..... 318/603; 139/97, 103, 139/109, 102, 110, 37, 25, 26, 27, 104, 317, 318, 319, 188 R, 190; 310/266; 73/619; 66/219

[56] References Cited

U.S. PATENT DOCUMENTS

| | | | |
|---|---|---|---|
| 3,072,153 | 1/1963 | Law | 139/102 |
| 3,529,298 | 9/1970 | Lourie | 66/218 X |
| 3,695,302 | 10/1972 | Jud | 139/27 |
| 4,106,492 | 8/1978 | Schuette et al. | 73/619 X |
| 4,294,290 | 10/1981 | Freisler | 139/26 |
| 4,350,941 | 9/1982 | McClure et al. | 318/603 |
| 4,554,472 | 11/1985 | Kumatani | 310/266 |
| 4,721,134 | 1/1988 | Dorman et al. | 139/25 |
| 4,827,985 | 5/1989 | Sugita et al. | 139/25 |
| 4,884,597 | 12/1989 | Tamura et al. | 139/25 |

FOREIGN PATENT DOCUMENTS

| | | |
|---|---|---|
| 0633837 | 12/1982 | Switzerland . |
| 1101508 | 1/1968 | United Kingdom . |

OTHER PUBLICATIONS

L'Industrie Textile, Nr. 1041, Jan. 1975 (Paris, FR), E. Seifert; "Une machine a projectile pour tissage eponge", pp. 21-24.

*Primary Examiner*—Andrew M. Falik
*Attorney, Agent, or Firm*—Kenyon & Kenyon

[57] ABSTRACT

To operate the terry loom, one or more pile-forming elements is actuated by separate drives on an individual pick basis and in a freely triggerable manner and at a loom speed. Any desired terry cadence can be produced in any desired sequence without stopping the loom and changing mechanical control and actuating means. Pile height can also be varied as required. The terry loom has at least one servomotor as a separate drive. The servomotor, which is triggered by means of a control and adjustment circuit arrangement, drives the pile-forming element by way of a reduction transmission and transmission elements. The servomotor can be preferably brushless and electronically commutated and have a low mass inertia rotor and high-field strength permanent magnets.

25 Claims, 10 Drawing Sheets

TERRY LOOM HAVING PROGRAMMABLE PILE FORMING ELEMENTS

This invention relates to a terry loom and to a method of operating a terry loom. More particularly this invention relates to a terry loom having pile-forming elements.

In conventional terry looms, the terry rhythm or the kind of terry product being woven is determined by mechanical means such as cams, change gears and levers. However, these mechanical means must be changed when the kind of terry being woven is to be changed. This operation is very elaborate and causes downtimes. As a rule, the kind of terry cannot be changed without stopping the loom. The changeover from a terry weave to a plain weave requires a mechanical coupling device which cuts the complete terry device into and out of operation very abruptly in a single revolution. Impacting occurs particularly when the terry device is cut into operation, becomes increasingly difficult to deal with as loom speeds increases, and causes increasing wear. Sporadic alterations in the mechanically predetermined kind of terry, such as an additional plain pick in 3-pick cloth to strengthen a transition also call for additional mechanical changeover means.

Pile height can be altered only within very narrow limits on conventional terry looms. Such looms have two pile heights but a mechanically complex operation is required to change over from high pile to low pile. Continuously varying or controlling pile height in order to be able to achieve an exactly predetermined constant pile weight and observe the pile height very accurately over a prolonged period are operations which have to be done very slowly and which are possible only to a limited extent. Even then, additional mechanical means are necessary as, for example, as described in U.S. Pat. No. 4,294,290 or the corresponding Swiss Patent 633,837. The final result is a mechanical limitation on terry weaving affecting patterning, loom output and cloth quality.

Accordingly, it is an object of the invention to provide a terry method and a terry loom for performing the method which can overcome the mechanical limits of past looms and which also permit a general automation of terry weaving.

It is another object of the invention to increase the output of a terry loom.

It is another object of the invention to increase the cloth quality output by a terry loom.

It is another object of the invention to increase the profitability of a terry loom.

Briefly, the invention provides a method operating a terry loom having pile-forming elements wherein the movement of the pile-forming elements are controlled for individual picks and in a free manner.

The method is to be of use in all kinds of pile production, particularly in the case of sley control and cloth control. The loom is to be able to perform all the known terry rhythms in any sequence without stoppage of the loom and without any changeover of mechanical elements. The loom is also to be able to provide new kinds of pile patterning.

A number of pile heights are to be provided and pile height is to be adapted to be varied continuously and at any speed.

In accordance with the method during the operation of a terry loom having pile-forming elements, one or more pile-forming elements is or are actuated by one or more separate drives and triggered for individual picks and freely i.e., independently of the main drive of the loom. This can therefore proceed, although not driven mechanically by the main motor of the loom, at full loom speed.

It therefore ceases to be necessary to weave in a mechanically fixed terry rhythm, such as 3-pick or 4-pick groups. Instead, any required terry rhythm can be formed, and changed in any desired sequence, by triggering of the pile-forming elements on an individual pick basis. Similar considerations apply to pile height, which can be triggered as required, for example, to produce a number of pile heights with an abrupt or continuous change between the different heights, a wavy or saw tooth pile height pattern and so on.

The separate drive and therefore the pile-forming elements can be actuated by a sequence of freely programmable pulses adapted to loom cycles and to the nature of loom operation. This feature helps towards a general optimization and automation of terry weaving.

This pulse sequence can be so adapted to shedding as not only to produce the terry movements but also to equalize warp tensions in the shed.

The terry loom is distinguished by at least one servomotor as a separate drive and coupled by way of a reduction transmission and/or transmission elements with at least one pile-forming element. The servomotor is connected by way of a circuit arrangement having a control for driving the servomotor and a control input connected to the control to deliver programmable signals to the control for actuating the servomotor for individual picks and freely. Preferably, the servomotor can be electronically commutated and brushless and have a rotor of low mass moment of inertia and high-field-strength permanent magnets. This construction provides a particularly highly dynamic drive giving high peak and continuous powers at relatively low heat dissipation values. The loom can therefore be operated very accurately and at high speeds and outputs.

Other advantageous constructions can have servomotors having rare earth magnets and more particularly magnets made of Nd-Fe-B compounds. Their very high field strengths both in absolute terms and as referred to their weight lead to very high motor powers and loom speeds. Power can be further increased in a simple manner by cooling the stator of the servomotor.

The terry loom can have as many triggered pile-forming elements as required. The pile-forming element can be drivable directly and be, for example, a vibrating roll which modulates pile warp tension and which can briefly reduce the same, particularly during full beat-up, to a very low value to ensure very high cloth quality.

Alternatively, the pile-forming elements can be driven in a basic movement by the loom main motor and the basic movement can be subjected only to additional modulation and control by the servomotor. For example, in the case of a terry loom having a sley control, the sley can be provided as a pile-forming element having partial beat-up, the servomotor controlling only the shortening of sley movement.

In the case of terry looms having cloth control, the cloth-controlling elements, such as a whip roll and a breast beam, can be triggered by one or more servomotors. In this event, the whip roll and the breast beam can, in a particularly simple construction, be connected as pile-forming elements to a coupling element.

The pile-forming elements on both the side uprights of the loom can be driven symmetrically by an associated servomotor, the two servomotors preferably being driven and controlled synchronously by just a single motor control. This ensures completely symmetrical pile patterns even in the case of substantial cloth widths.

The high dynamics of the servomotor can be transmitted as far as the pile-forming element by a reduction transmission which has a low mass inertia primary element on the motor shaft.

A number of control inputs, measurement inputs and/or data outputs of the control and adjustment facility and an associated computer unit can be provided, two-way communication with the loom being possible. This feature provides an even more universal control and adjustment of the terry loom and also enables operating data to be prepared and delivered for further processing and for optimization of cloth quality, loom performance and profit.

Theoretically, a number of pile-forming elements each having one or two servomotors can be triggered independently by the same control and adjustment circuit arrangement so that each such element can be given optimal individual adjustment to suit the required weaving result.

In addition to the pile-forming elements and their servo-drives, at least one warp-tensioning element can have an associated further servomotor whose triggering is adapted to shedding. This feature provides additional control and optimization of ground warp tension.

These and other objects and advantages of the invention will become more apparent from the following detailed description taken in conjunction with the accompanying drawings wherein.

Figure 2:
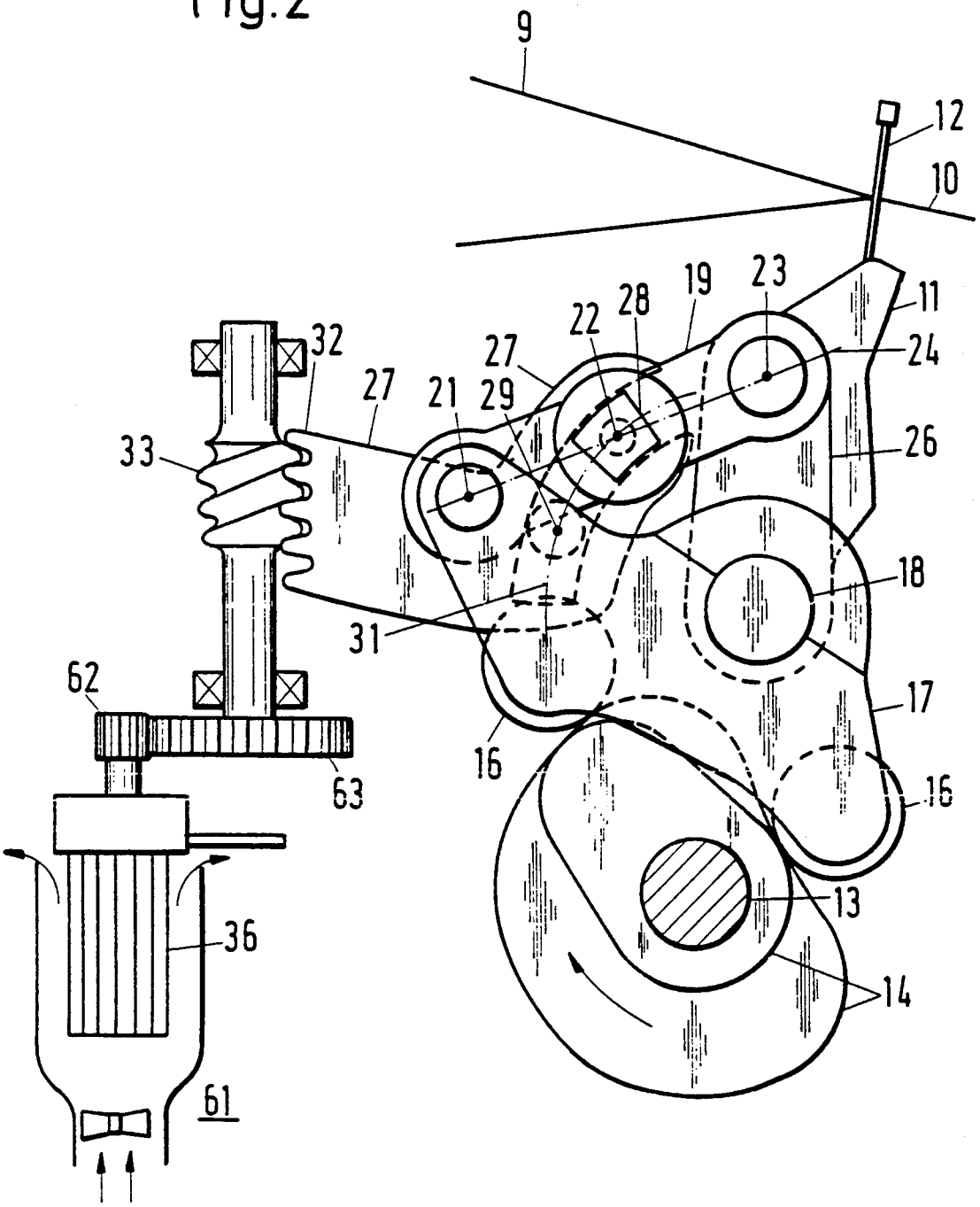
FIG. 2 illustrates a sley control having a servomotor and an articulated lever according to FIG. 1.
Figure 3A:
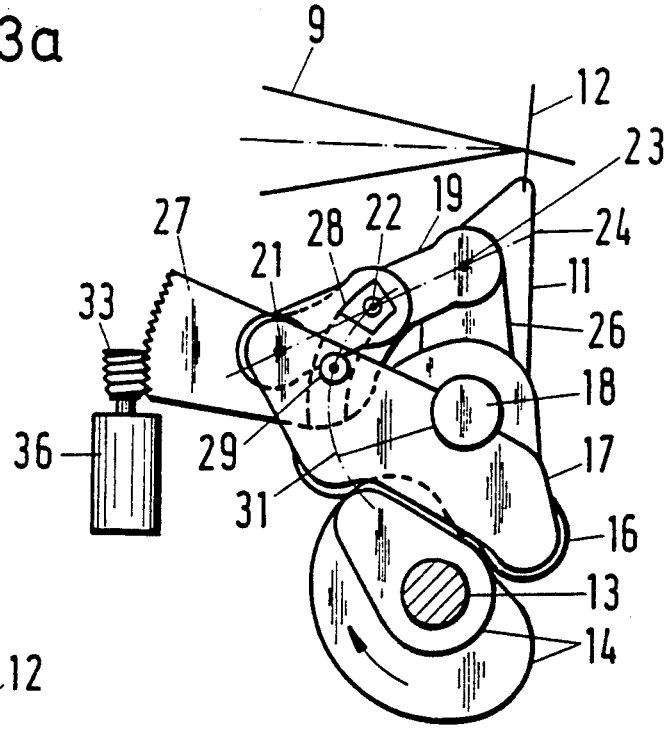
Figure 3B:
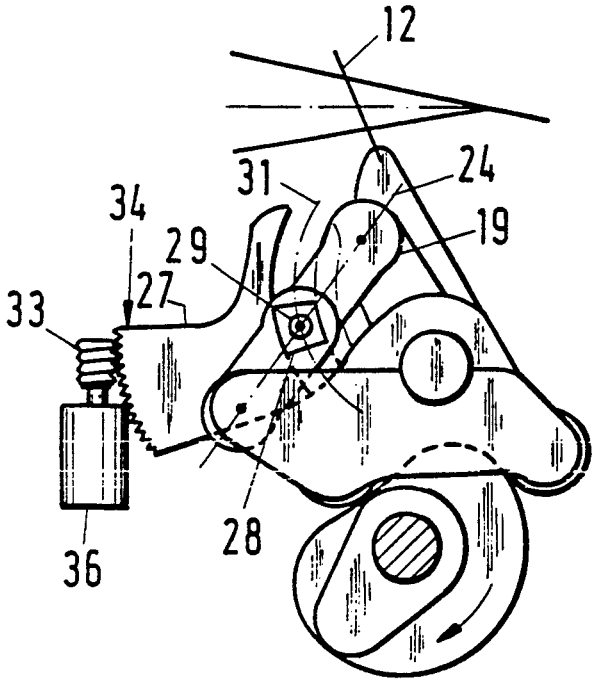
Figure 3C:
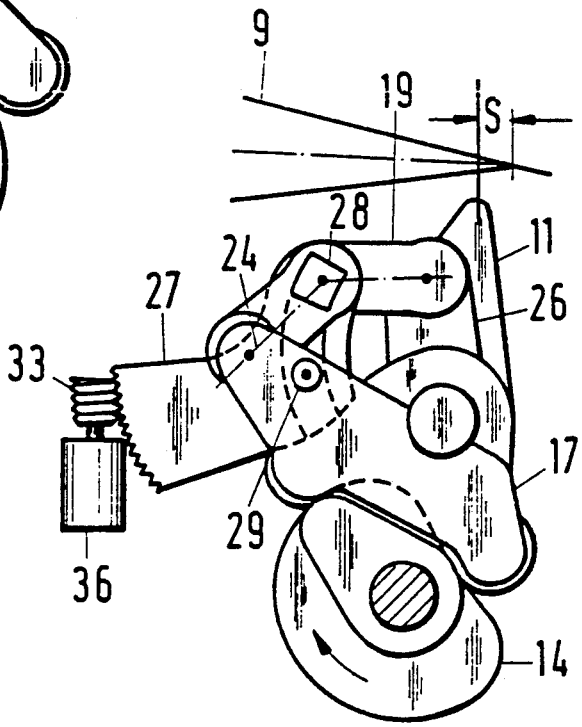
Figure 4:
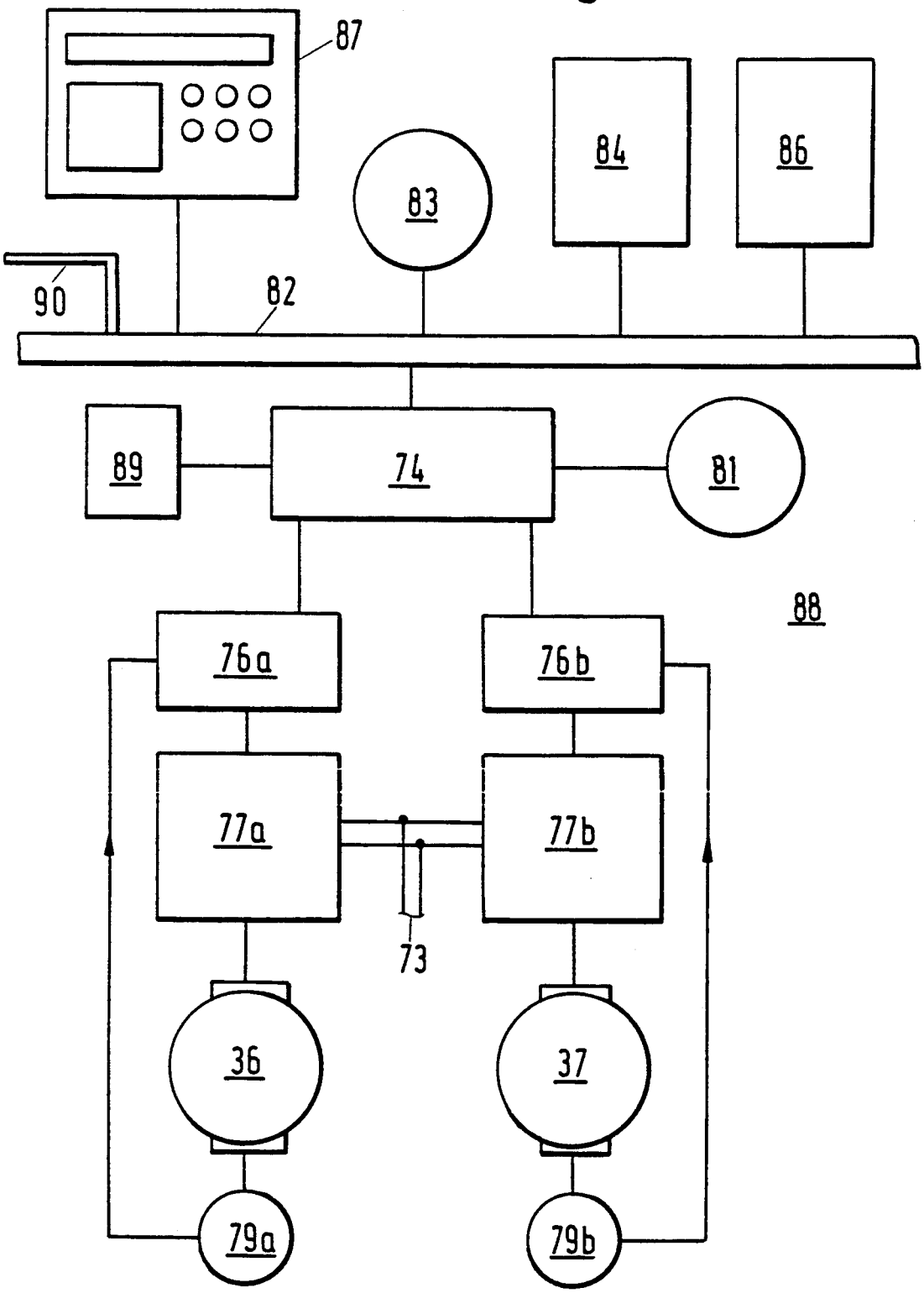
Figure 5:
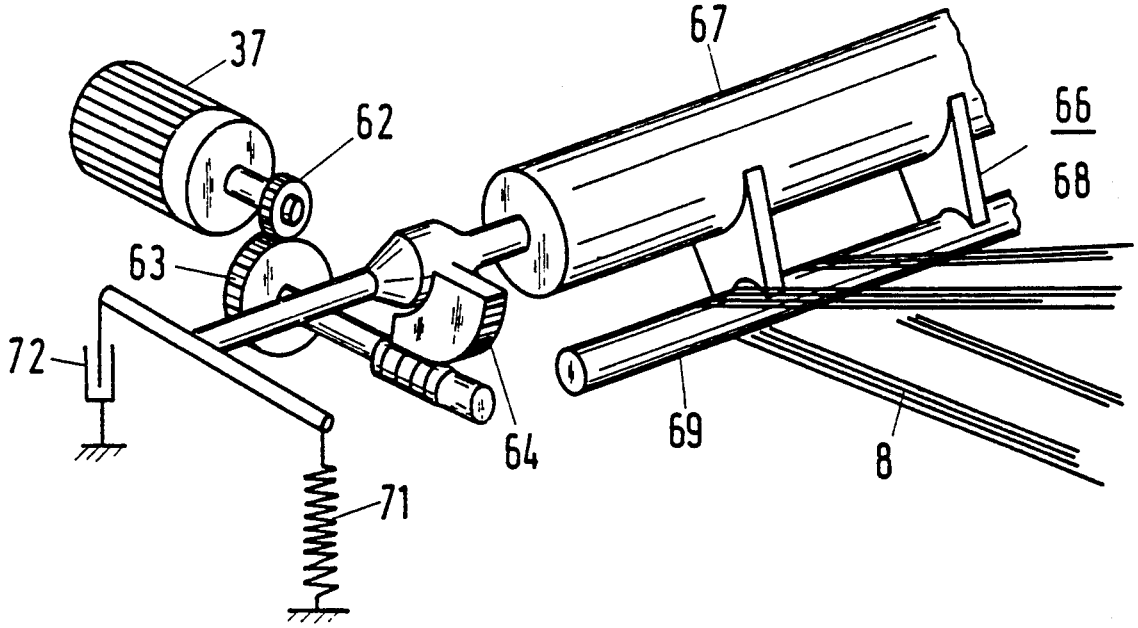
Figure 8:
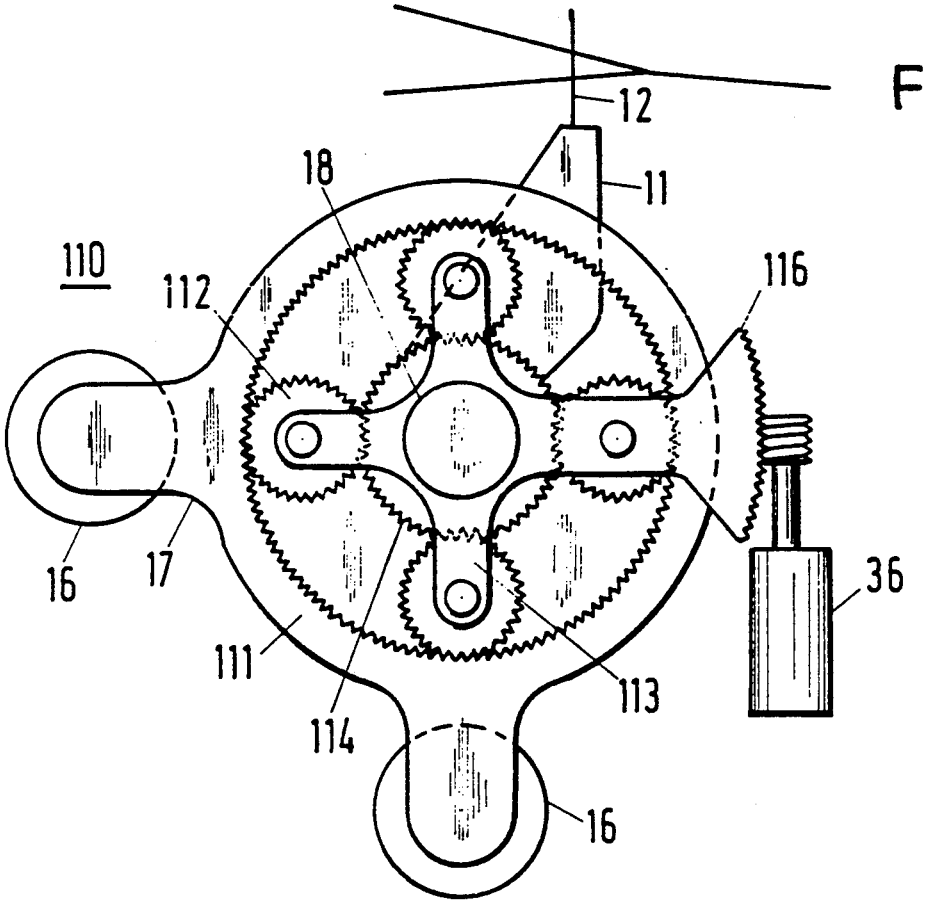
Figure 6A:
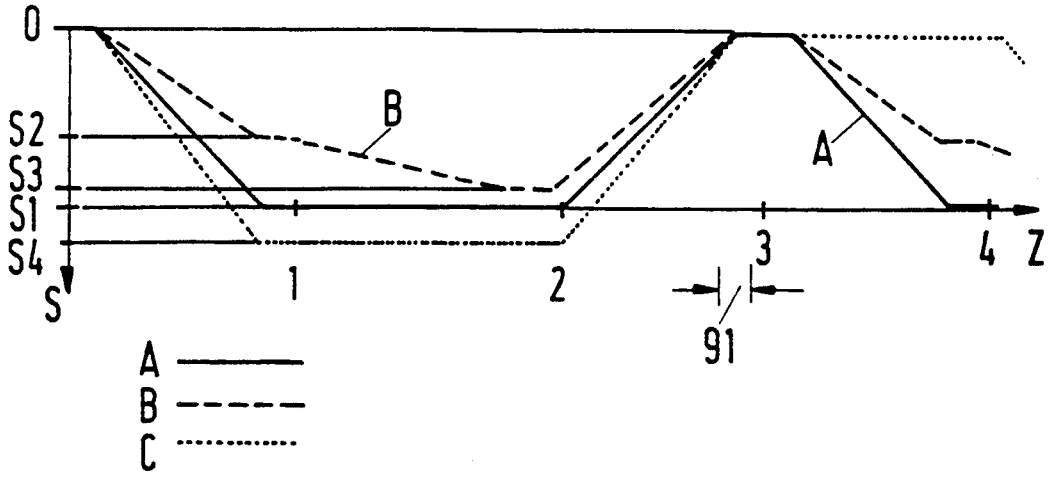
Figure 6B:
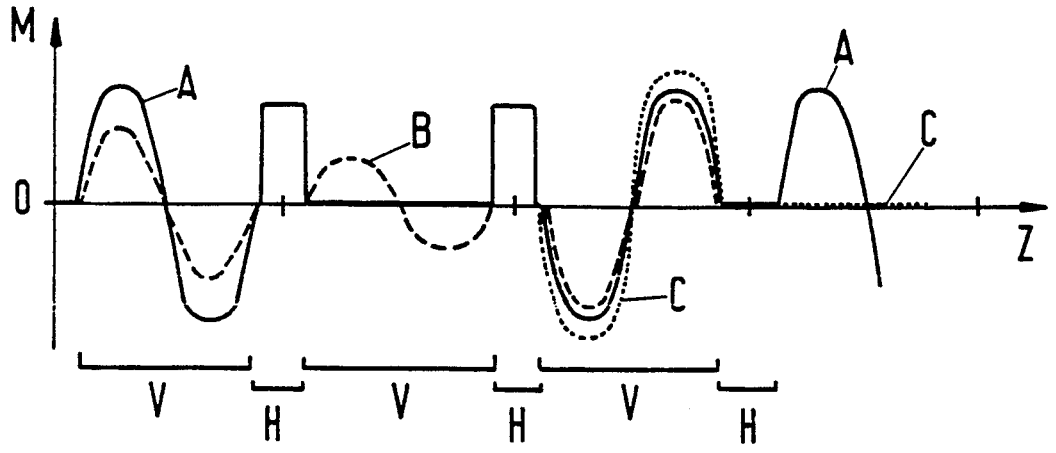
Figure 6C:
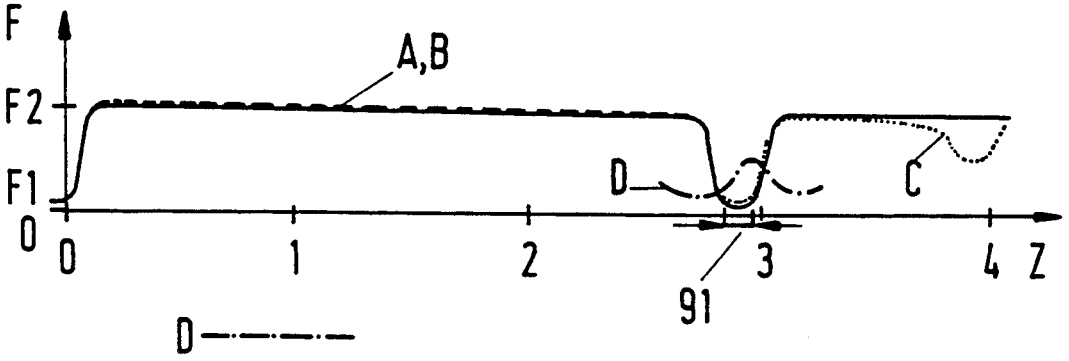
Figure 7:
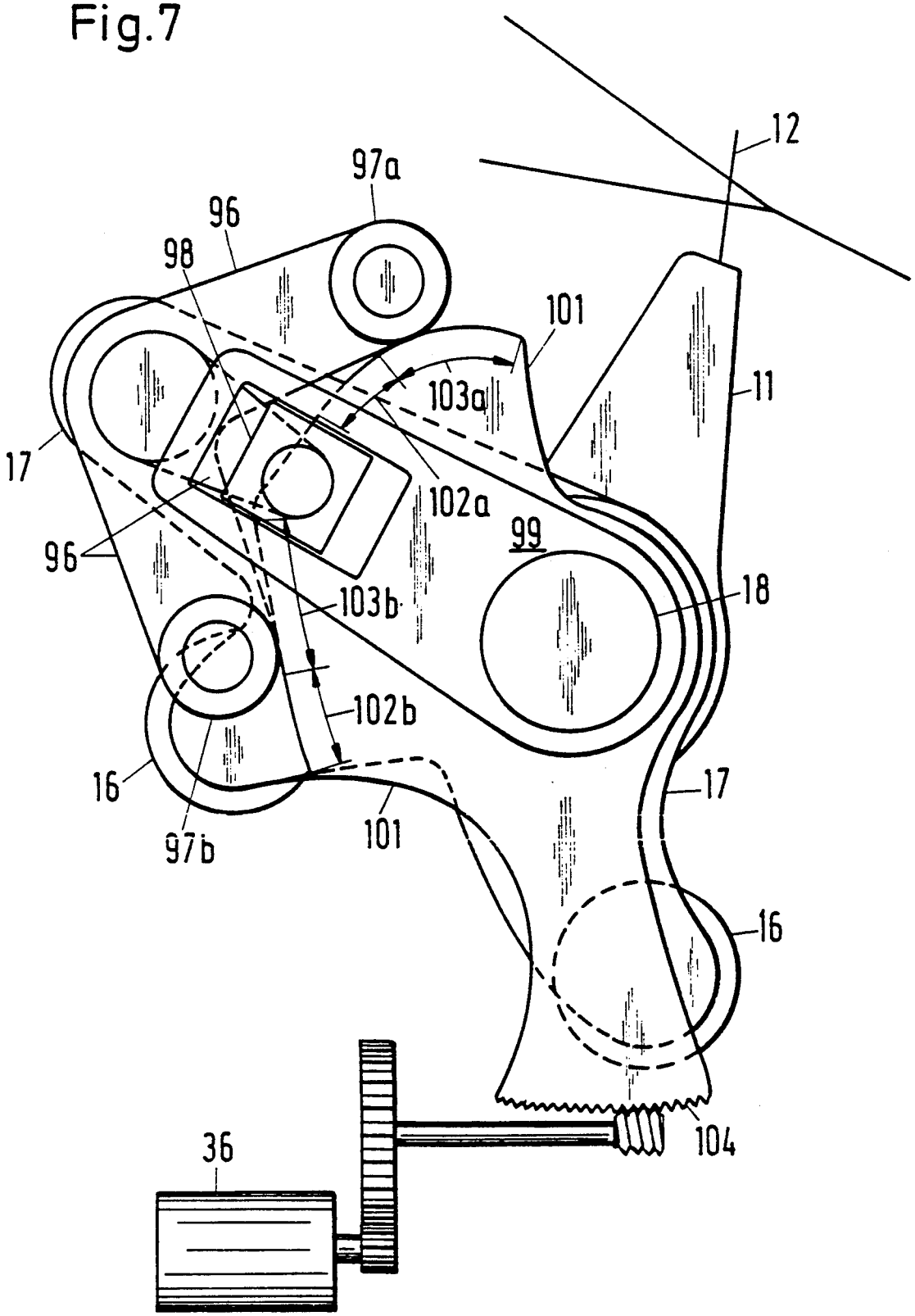
Figure 9:
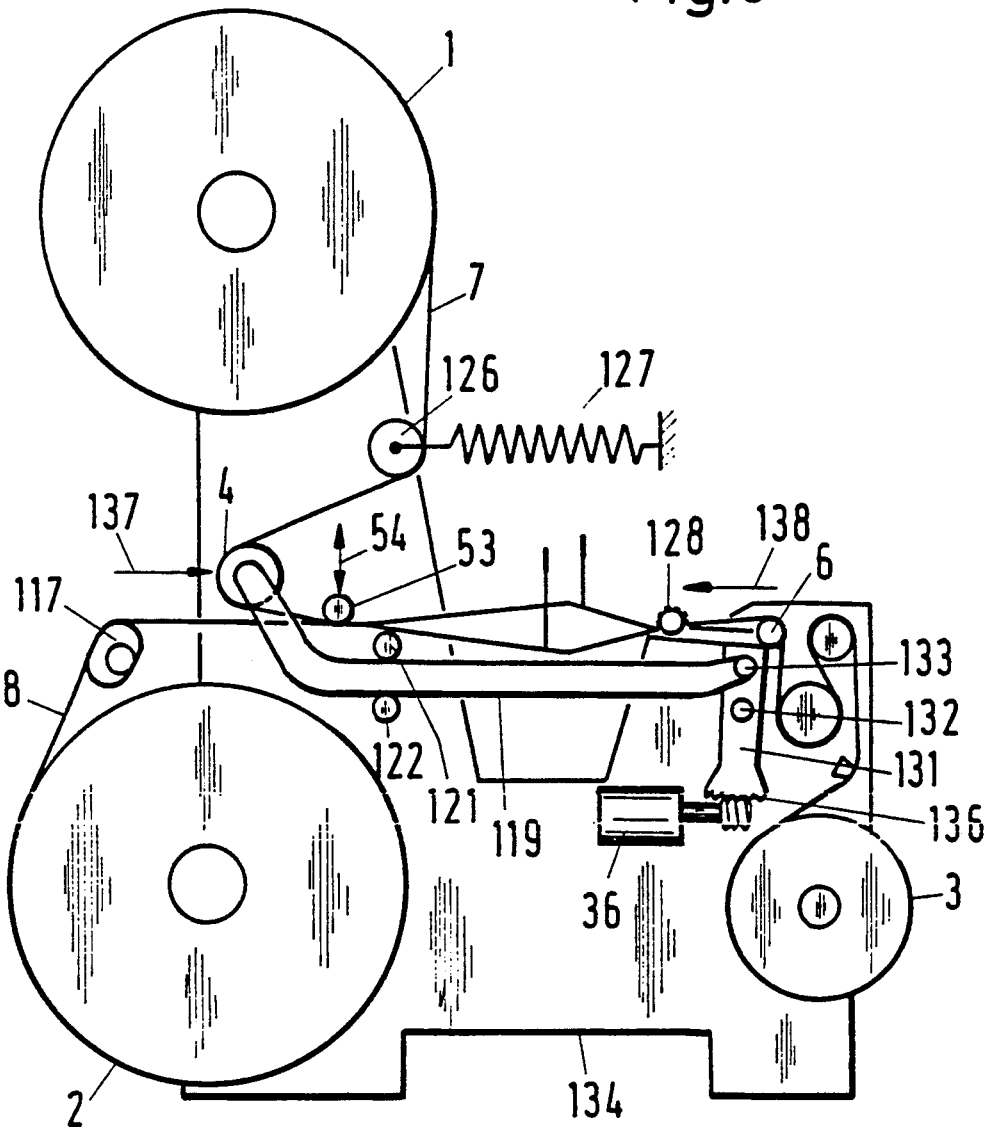
Figure 10:
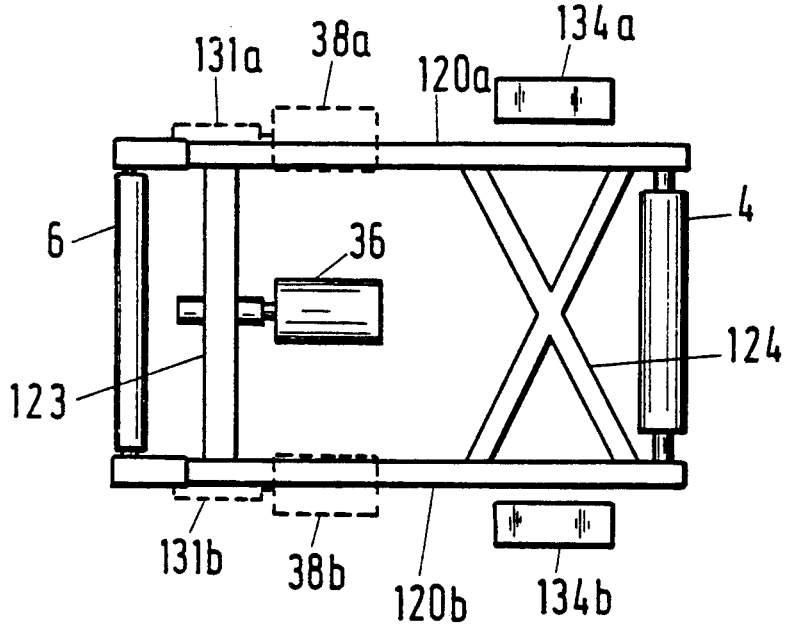
Figure 11:
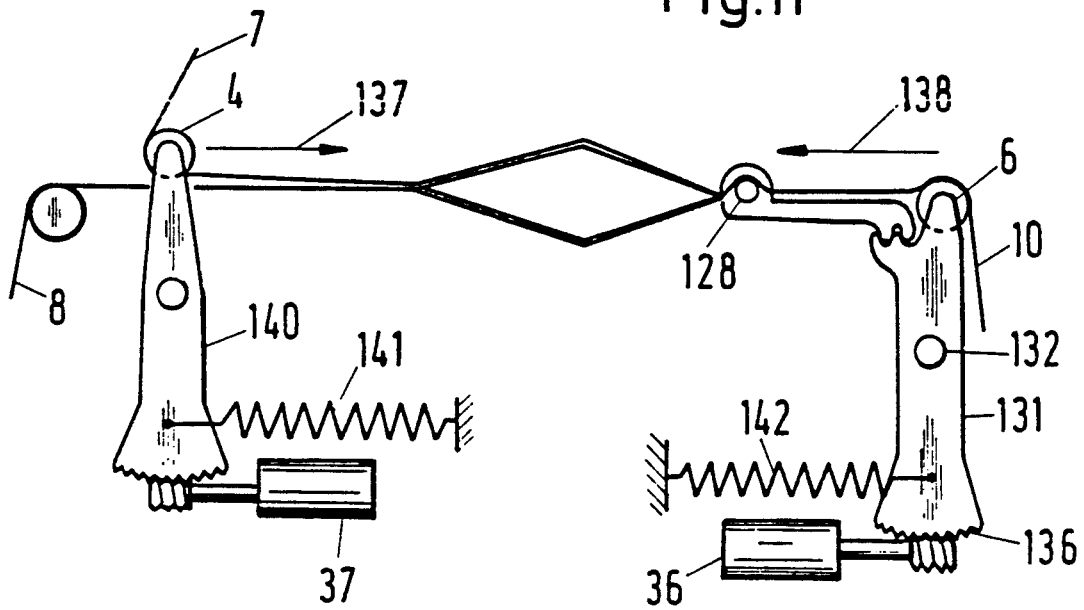
Figure 12A:
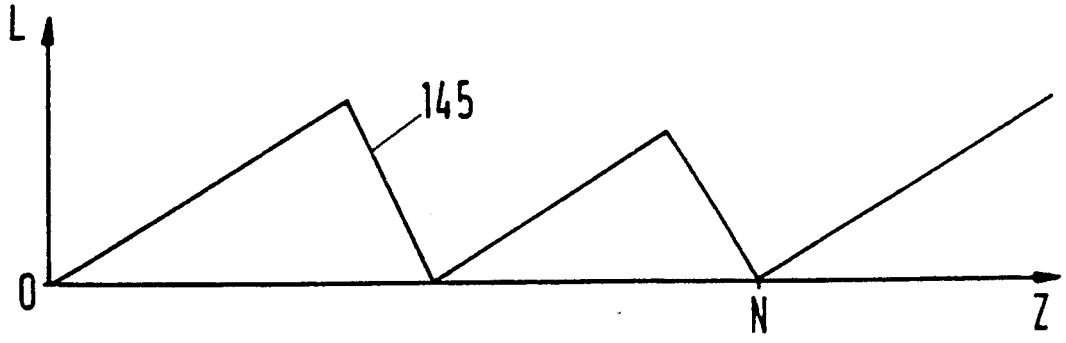
Figure 12B:
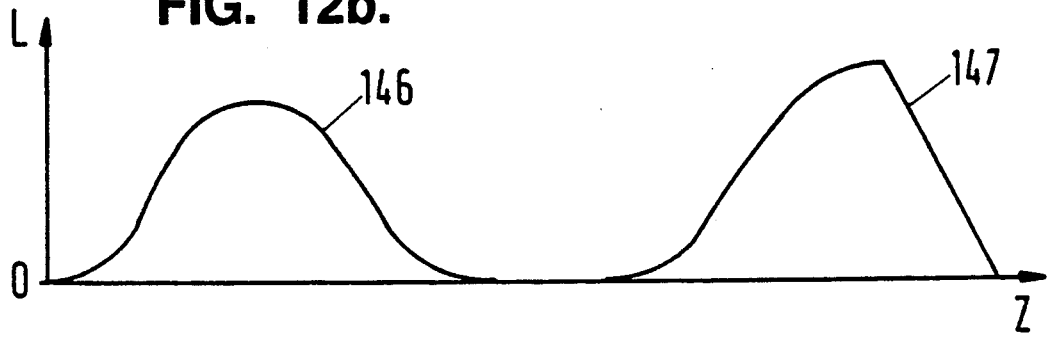
Figure 12C:
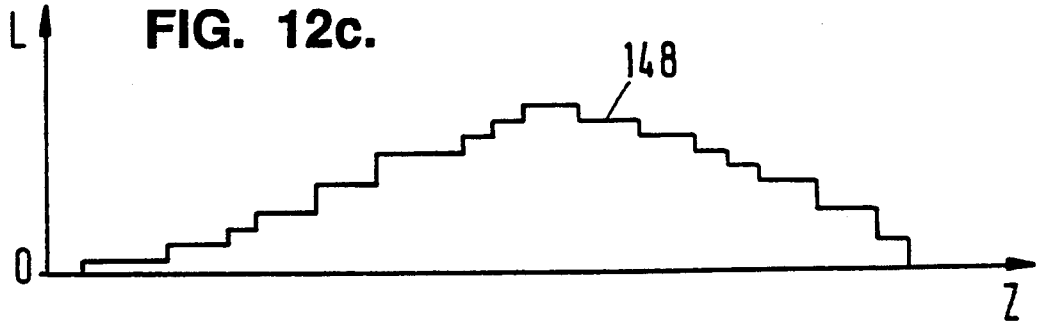
Figure 12D:
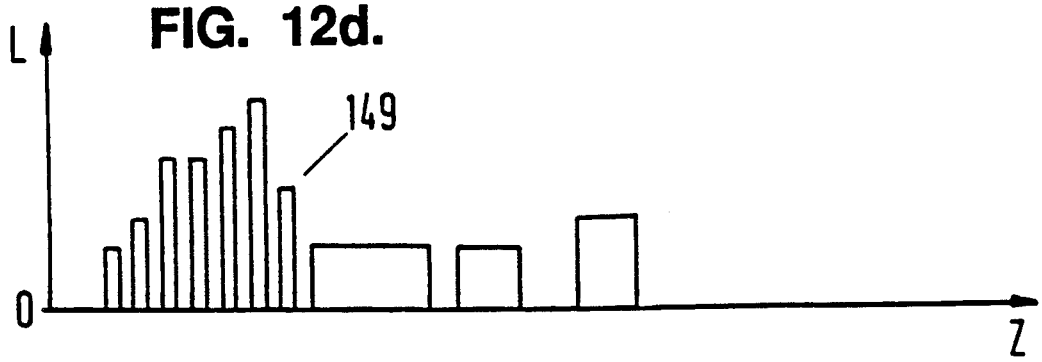

FIG. 3*a*, 3*b* and 3*c* show the sley control of FIG. 2 in various positions and operating states;

FIG. 4 is a circuit diagram of a terry loom according to the invention having a control and adjustment circuit arrangement;

FIG. 5 shows a servomotor-operated pile vibrator roll;

FIG. 6*a*, 6*b* and 6*c* are diagrams, covering a number of loom cycles and for various kinds of terry operation, showing pre-beating distance movement, displacement and stop torques of the terry elements and pile wrap tension;

FIG. 7 illustrates a cam-operated sley control in accordance with the invention;

FIG. 8 illustrates a sley control using planetary gearing in accordance with the invention;

FIG. 9 illustrates a terry loom having a cloth control and a coupling element in accordance with the invention;

FIG. 10 illustrates a cloth control according to FIG. 9 with one or two servomotors;

FIG. 11 illustrates another example of cloth control; and

Figure 1:
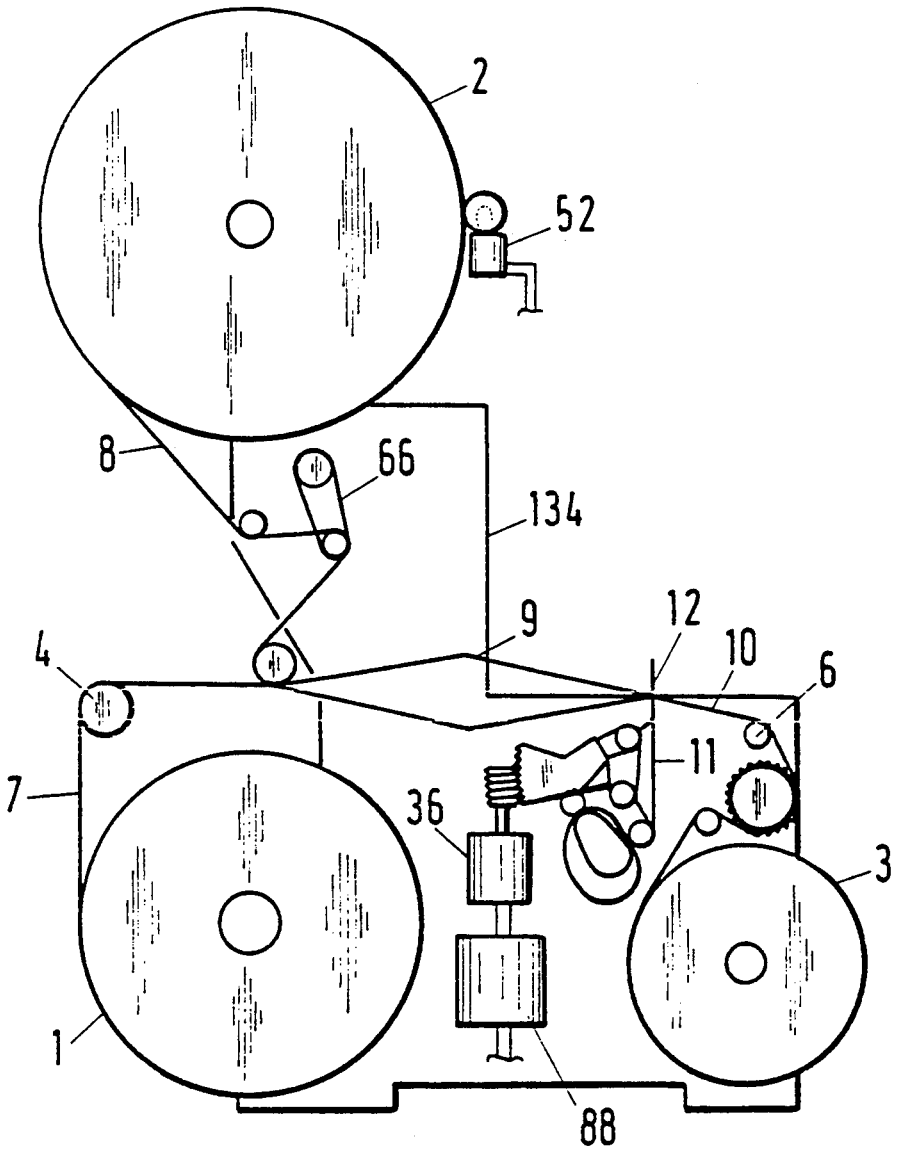
FIG. 1 illustrates a terry loom according to the invention with sley control.

FIGS. 12*a*, 12*b*, 12*c* and 12*d* graphically illustrate examples of pile height variations obtained in accordance with the invention Referring to FIG. 1, the terry loom is of generally known construction and includes a ground warp beam 1, a pile warp beam 2 and a cloth beam 3. A whip roll 4 is provided at one end for guiding warp yarns 7 from the ground warp beam 1 into a shed 9 while pile warp yarns 8 are directed from the pile warp beam 2 over a vibrator roll 66 to the shed 9. The resulting cloth 10 is guided via a breast beam 6 to the cloth beam 3. During operation, a sley 11 moves a reed 12 within the shed 9 to form the cloth 10. To this end, a servomotor 36 is provided for actuating a sley control along with a circuit arrangement 88 for programming the servomotor 36.

Referring to FIG. 2, wherein like reference characters indicate like parts as above, the sley control is constructed to pivotally move the sley 11 about a fixed pivot 18 between a retracted position (FIG. 3*b*) and a beat-up position (FIGS. 3*a*). The sley control is driven off a main drive shaft 13 of the loom via a pair of rotatable cams 14 and includes a transmission for moving the sley 11 in the cadence of the cams 14.

The transmission includes a cam follower lever 17 which rotates about the fixed pivot 18 and carries a pair of rollers 16 which engage the cams 14. As indicated, the transmission also includes means for adjusting the movement of the sley 11 from the retracted position (FIG. 3*b*) towards the beat-up position (FIG. 3*a*). This means includes an articulated lever 19 which is pivotally connected at one end on an axis 21 to a pin secured to the cam follower lever 17 and at the opposite end on an axis 23 to a lever 26 which is fixed to the pivot 18 and, thus, the sley. The articulated lever 19 is formed of two sections which are hinged together on an intermediate axis 22 and connected to a slide block 28.

A slide block guide 27 is articulated as an actuating lever to the cam follower lever 17 to rotate about a stationary bearing 29 in the loom frame and has a guide slot to receive and guide the block 28 along a guide line 31. The guide 27 is provided with a toothing 32 on one end which meshes with a worm 33 driven off the servomotor 36 via suitable gears 62, 63. The servomotor 36 also has a cooler 61 in the form of a ventilator for supplying cooling air along a ribbed stator casing of the servomotor 36.

The operation of the sley control of FIG. 2 will be described in greater detail with reference to FIGS. 3*a*–3*c*. During full beat-up, shown in FIG. 3*a*, the three axes 21–23 of the lever 19 all lie on straight line 24. The movement of the lever 17 is, in this case, transmitted completely and unchanged to the sley 11. To this end, the guide line 31 must extend as a radius to the fulcrum of the lever 17 or pivot 18. The servomotor 36 has previously moved the guide 27 into this position.

FIG. 3*b* shows the sley in the retracted rear position. Lever 19 is still in the extended (straight) position but the servomotor 36 has rotated the guide 27 downwardly around the pivot 29 in a direction 34 so that the line 31 extends correspondingly steeper than previously. In FIG. 3*c*, the lever 17 is rotated further into the same beating-up position as is shown in FIG. 3*a*. However, because of the movement of the guide 27 and consequent movement of the block 28, the lever 19 is bent and the sley stroke has been shortened to produce a partial beat-up in which the reed 12 has been set back from the full beat-up in FIG. 3*a* by a pre-beating distance S.

The servomotor 36 in association with the movement of the guide 27 can therefore trigger and set any required distance S in any rhythm and at any speed. Conventional looms cannot do this since their pile-forming elements, like the sley control comprising a cam follower lever, articulated lever and slide block guide in the present case, have to be actuated by way of an additional elaborate and complicated mechanism involving cams, linkages and couplings, something which is feasible only in narrow limits and at a fixed terry rhythm (3-pick or 4-pick).

The terry control with a servomotor and reduction transmission, in addition to providing universal terry control, also obviates the substantial expense previously entailed for costly wearing mechanical control and actuating elements. For example, the torque moment during beating-up no longer has to be taken up by additional mechanical stopping means since this is provided by the same servomotor 36. Other important features of the facilities are the considerably reduced mass inertias and the avoidance of impact stresses such as occur in conventional terry looms, for example, at the change from plain weaving to terry weaving when the complete mechanical terry control and actuation must be engaged accurately and abruptly.

The servomotor 36 has a low mass inertia rotor having high field strength permanent magnets—i.e., magnets having high remanence and a high demagnetizing field strength. Due to the reduced mass inertia of the rotor, the motor 36 has high dynamics, while high field strength produce high motor torques and outputs, with the overall result of a high loom speed. Rare earth magnets such as SmCo compounds and more particularly Nd-Fe-B compounds are advantageous materials for the magnets. The use of permanent magnets on the servomotor rotor means that ohmic losses arise only on the motor stator and not on its rotor. The heat of dissipation can be removed here readily and substantially, for example, by means of air or water cooling of the stator. This leads to a further increase in servomotor performance with respect to overload peaks, particularly when Neodym magnets are used.

Like the servomotor rotor, the reduction transmission and the transmission elements are constructed to have very reduced losses due to mass inertia. To this end, a two-stage reduction transmission having a lightweight pinion gear 62 on the servomotor spindle is used in FIG. 2. The transmission, which is effective as a low mass inertia primary element, reduces the motor speed abruptly, for example, by a factor of from 3 to 5. In all, therefore, that proportion of motor power which is needed to accelerate the moving parts from the rotor via the reduction transmission and the transmission element to the pile-forming elements is very reduced and thus enables the required very high loom speeds to be achieved.

FIG. 4 is a block schematic diagram for the terry loom. As shown, a control and adjustment circuit arrangement 88 having a control input 89 comprises a control 74 which triggers a motor controller 76*a*, 76*b*. Each controller 76*a*, 76*b* drives a respective servomotor 36, 37 by way of a power pack 77*a*, 77*b* connected to a supply 73. Each controller 76*a*, 76*b* is connected for synchronization to a motor angle pickup 79*a*, 79*b*. A number of servomotors 36, 37 can be triggered by the control 74 to actuate a number of pile-forming elements independently of one another (76, 77, 79 a and b in each case). The pre-beating distance and, therefore, pile height can therefore be control ed in very small steps of e.g. as little as 0.1 mm.

The control 74 is connected to a loom bus 82 and to a loom crank angle pickup 81 to ensure absolute synchronization of the motor control with the loom for forwards and reverse running. Also, coordination with the warp let-off 84, the shedding motion 86 and the other loom functions such as cloth take-off and color changer control proceed by way of the loom bus 82. An indicating and operating unit 87 and various measurement inputs 83, for example, of warp tension pickups, and data outputs 90 are connected to the loom bus 82. Two-way communication between the weaver and the warp tension control and a link with a central directing system are therefore provided.

The circuit arrangement 88 comprises a computer with memory. Consequently, terry patterns having a repeat N can be generated in a sequence of individual picks, stored and called up again. A prebeating distance SZ—S1, S2, S3 . . . SN—is associated with each pick or weaving cycle Z=1, 2, 3 . . . N. A full beat-up, and plain weaving, corresponds to the prebeating distance S=0, so that the conventional mechanical clutches for cutting terry weaving into and out of operation are omitted. A terry repeat N can be of any required size. A simple 3-pick group such as curve A in FIG. 6 then becomes N=3, Z=1, 2, 3, S=S1, S2, 0. However, new pile patternings, such as are shown in FIG. 12, can extend over a terry repeat N of hundreds or thousands of picks with any required variation of terry rhythms and pile height.

The use of a pile wrap length pick-up 5 (FIG. 1) connected to the circuit arrangement 88 can help, for example, to ensure very accurately and automatically a required predetermined pile weight. To this end, the circuit arrangement 88 continually determines the measured linear consumption of pile warp per pick, compares this with the set value and immediately controls out any variations in invisibly small steps by altering the pre-beating distance. Variations in pile weight such as occur conventionally can therefore be eliminated with a corresponding cost saving.

In the example of FIG. 2, the basic movement of the controlled sley, as pile-forming element, is imparted by the main motor of the loom, the servomotor 36 merely triggering a modulation of the basic movement—i.e. a required feed distance and, therefore, the pile height.

Referring to FIG. 5, a pile vibrator roll 66 in the form of a whip roll may be directly driven as a secondary pile-forming element by a second servomotor 37.

The function of the pile vibrator roll 66 is, during the almost impact-like pushing-together of the pile at full beat-up, to advance the pile warp correspondingly abruptly and with a very reduced tension. To this end, the pile vibrator roll 66 must be able to move very rapidly and without delay and lightly. However, a minimal pile warp tension must be maintained the rest of the time to ensure undisturbed warp delivery without yarn crossings. Conventional sprung vibrator roll systems cannot meet these conflicting requirements satisfactorily (FIG. 6*c*). However, the servomotor-controlled whip roll 66 of FIG. 5 can satisfy the conflicting requirements and trigger optimum warp tension patters for all kinds of operation and terry systems (FIG. 6). As shown, a second servomotor 37 drives the roll 66 by way of a pinion 62, intermediate stage 63 and quadrant 65. The roll 66 comprises a rigid top roll 67, a lightweight swinging tube 69 and connecting supports 68. The result is a low mass inertia roll 66. An additional adjustable biasing spring 71 and a damper 72 acting on the roll 66 can be provided as indicated. The servomotor 37 is triggered by the terry control 74 of FIG. 4 but has its own motor control (76*b*, 77*b*, 79*b*).

The operation of the servomotor-controlled terry element in the form of a sley (FIG. 2) and vibrator roll (FIG. 5) will be described in greater detail with reference to the diagrammatic illustrations of FIG. 6*a*, 6*c* and 6*c*.

FIG. 6*a* shows the pre-beating distance S plotted against time over a number of loom cycles Z. FIG. 6*b* shows the pattern of the corresponding motor torques M for movement over the distance S (displacement torque V) and of the stopping torques H required at beating-up. FIG. 6*c* shows the pattern of the pile warp tensions F. The curves A, B and C shows the pattern of the pile warp tensions F. The curves A, B and C show three examples of different kinds of terry operation, curves A corresponding to a 3-pick terry rhythm with a pre-beating distance S1, curves B corresponding to a 3-pick terry rhythm with a reduced first pre-beating distance S2 and a second pre-beating distance S3 slightly modified as compared with S1, while the curves C denote a 4-pick terry rhythm comprising two partial beat-ups having a relatively large pre-beating distance S4 and two full beat-ups.

Since pile height increases substantially proportionally to the distance S, curve B therefore corresponds to a slightly lower pile height than curve A. By means of the shortened partial beat-up S3 of the first pre-beating group of picks, for example, pile loops can be prevented from dropping on to the wrong side of a delicate fabric, thus ensuring better fabric quality. Curve C provides a considerably increased pile height corresponding to S4 and the two full beat-ups 3, 4 after the two partial beat-ups 1 and 2 ensure pile loops that are tied in tightly.

The rounded pattern of the displacement torques V of the servomotor in FIG. 6*b* can be so triggered that no hard impacts occur while the substantially rectangular stopping torques H required during sley beat-ups indicate torque jumps. The displacement torques of the two partial steps in the first and second cycle of curve B are correspondingly smaller than the displacement torque in the single displacement stop of curve A. The stopping torques can be received by the servomotor or by a self-locking construction of the reduction transmission (toothing 32 and worm 33).

The pile warp tensions F of FIG. 6*c* have a very similar pattern in all three examples A, B and C. The vibrator roll is so triggered by the servomotor that the pile warp tension F is during the pushing-together phase 91 of the pile momentarily reduced to a value Fl which can be almost as small as required and which amounts to only a few grams; F1 can be varied to control pile height. Between the phases 91, the tension rises to a higher and substantially constant value F2 which can be optimally adapted to the yarn and to operating parameters. The curves A, B, C have an optimal warp force patterning which conventional vibrator rolls cannot provide, as indicated by a curve D, where the minimum warp force Fl and the optimum phase position and pulse shape as regards the phase 91 cannot be provided.

FIG. 7 shows a sley control comprising a cam 101, a cranked rocker 96, rollers 97*a*, 97*b*, a slide block 98 articulated to the rocker 96 and a link 99 having a slide block guide. As in the case of FIG. 2, the sley drive is by way of a cam follower lever 17 which runs on complementary cams (not shown) and to which the rocker 96 is articulated. The rollers 97*a*, 97*b* of the rocker 96 engage with a radial part 102*a*, 102*b* of the cam 101 or with a non-radial part 103*a*, 103*b*. The slide block 98 articulated to the rocker 96 therefore moves in accordance with the position of the rollers 97*a*, 97*b* on the cam 101. The position of the slide block 98 is transmitted to the sley by way of the link 99 which is rigidly connected to the sley 11. A pre-beating distance adjustment on the reed 12 is therefore produced by way of the rocker 96 and slide block 98 in accordance with the position of the cam 101, the radial part 102*a*, 102*b* thereof corresponding to full beat-up (zero prebeating distance) while the cam part 103*a*, 103*b* can be used to set up any required pre-beating distance from greater than zero to the maximum. The drive is again by a servomotor 36 acting through a reduction transmission on toothing 104 of the cam 101. An advantage of this construction is that the stopping torques which arise upon beat-up of the sley 11 are absorbed mostly by bearing forces of the cam 101 and do not have to be taken up by the servomotor 36 or reduction transmission.

Referring to FIG. 8, another sley control construction has a planetary transmission 110. The cam follower lever 17 is connected to a rotatable annulus 111 of the transmission which defines a sun gear while a plurality of planetary gears 112 are rotatably mounted on a carrier 113 to mesh with the sun gear. The carrier 113 has a toothed arm 116 which is driven by the servomotor 36 in the manner hereinbefore described. A sunwheel 114 is rigidly connected to the sley 11 and is disposed concentrically of the sun gear in meshing relation with the planetary gears 112.

When the servomotor 36 and carrier 113 are stationary, the complementary cams 14 drive the sley 11 in a basic movement. However, the sley 11 must, during each weaving cycle, move completely to the rear into the beating-up position (as in FIG. 3*b*), and for this the servomotor 36 must always move into the corresponding end position. This end position of the servomotor 36 corresponds just exactly to a predetermined pre-beating distance of e.g. 10 millimeters (mm) and one reciprocation by the servomotor 36 is necessary in every cycle for every other pre-beating distance including full beat-up. This is not necessary in the examples of FIGS. 2 and 7. In the case of the curve C of FIG. 6*a*, for example, only one reciprocation every four cycles is necessary. Another disadvantage feature is that the teeth of the planetary transmission have to withstand the stopping torques; on the other hand, the compact construction may be advantageous.

FIG. 9 shows a terry loom having a fabric control in which a servomotor 36 triggers the fabric-controlling elements which in this case are a whip roll 4 and a breast beam 6 effective as pile-forming elements. In contrast to FIG. 2, the ground warp beam 1 is disposed at the top and the pile warp beam 2 at the bottom for ready replacement. In fabric control, looping is effected by periodic horizontal movements of the cloth produced by means of the breast beam 6 and temples 128 so that the cloth fell is moved away from the reed beating-up zone by an amount corresponding to cloth stroke. There is no change in reed movement. The resulting pile height is substantially proportional to cloth travel (similarly to the pre-beating distance in the case of reed control). The breast beam 6 and temples 128 and whip roll 4 draw the ground warp 7 back to the beating-up station towards full beat-up but the light pile whip roll 117 must not simultaneously withdraw the pile warp 8. Consequently, during the pushing-together of the loops, the pile warp 8 must have a very reduced tension F again. The ground warp 7 and pile warp 8 must then be advanced together rapidly as far as the next partial beat-up by the cloth stroke which corresponds to a required pile height. To this end, the two whip rolls 4, 117 must detension the corresponding warps 7, 8 just as rapidly and simultaneously ensure the necessary warp tension values. This rapid warp advance over an accurately defined cloth stroke of pre-beating e.g. 20 millimeters (mm) (corresponding to the abrupt adjustment of feed distance in the case of the sley control of FIG. 6) takes place in less than one weaving cycle T. As in the case of sley control, the result is conflicting requirements for each of the two warp tensions in the various phases (fabric advance after full beat-up, fabric withdrawal before full beat-up and, in between, normal warp let-off speed) in order to produce optimal weaving properties and cloth qualities.

Conventional sprung whip roll systems cannot satisfactorily meet these conflicting requirements for ground warp tension and pile warp tension. However, the construction shown in FIGS. 9 and 10, can substantially fulfill these requirements.

As shown, a coupling element 119 connects the breast beam 6 and temples 128 to the whip roll 4. The coupling element 119, which is in the form of a frame as shown in FIG. 10, comprises side girders or bearers 120*a*, 120*a*, cross-bars 128 and lattice struts 124. The girders 120 run on guide rollers 121, 122 as shown in FIG. 9 and are articulated at their front end in a bearing 133 to a two-armed lever 131. The lever 131 has a pivot 132 and by way of a top arm actuates the frame 119, breast beam 6 and temples 128. The bottom arm of the lever 131 terminates in a toothing 136 via which the lever 131 is driven by means of the servomotor 36.

The frame 119 can be driven laterally at one end, by way of the lever 131 and the servomotor 36, or centrally. A central drive obviates asymmetrical twisting which may produce an asymmetrical pile formation. However, an advantageous and even more effective construction can have two servomotors 38*a*, 38*b* (see FIG. 10) disposed one each on a side upright 134*a*, 134*b* of the loom and each synchronously driving by way of a lever 131*a*, 131*b*, the girders 120*a*, 120*b* or coupling frame 119 and, therefore, the breast beam 6 and whip roll 4. In this event, the two servomotors 38*a*, 38*b* can be operated by just a single motor controller 76 and power pack 77.

Also, the pile whip roll 117 can be triggered as a secondary pile-forming element, as described with reference to FIG. 5, by another independent servomotor 37 of the terry control 74. In this case, the terry control 74 triggers three servomotors, namely the two synchronized servomotors 38*a*, 38*b* of the frame 119 and the independent servomotor 37 of the pile whip roll 117.

In addition to triggering of a servomotor by a pile-forming element for pile formation proper, an additional movement can be superimposed upon the element since the servomotor can, of course, be triggered as required by way of the circuit arrangement 88. For example, the pile-forming unit of the servomotor 37 and pile whip roll 117 can have a superimposed shed-compensating movement which compensates for alterations in warp length during shed changing.

There are various way of providing shed compensation for the ground warp 7, such as a deflecting roller 126 and a spring element 127. Another possibility is for spring elements to be associated with the whip roll 4 or frame 119 for shed compensation or for an additional warp-tensioning element 53 having an additional servomotor to be provided, for example, in the form of a warp-tensioning roll which is reciprocated vertically in the direction 54 and thus provides shed compensation or which can generally modulate an optimum ground warp tension timing.

Because of the frame 119, the warp forces 137, 138 acting on the whip roll 4 or breast beam 6 with temples 28 bear against one another so that the servomotor 36 is required to take up or overcome substantially no resulting warp force component. Consequently, wide fabrics having high warp forces . can be processed by relatively small highly dynamic servomotors of a power, for example, of from two to three kW. Also, very high loom performances can be provided. As the example without a frame 119 of FIG. 11 shows, the terry elements can be operated separately by one servomotor 36, 37 each, the breast beam 6 being driven as previously by the servomotor 36 by way of the lever 131 while a separately triggered servomotor 37 actuates the whip roll 4 by way of a lever 140. In this case, the warp forces 137, 138 are taken up preferably by biasing springs 141, 142 acting on the levers 131, 140. The springs 141, 142 are so adjusted that average warp forces for an average cloth stroke are just compensated for by their spring forces. Shed compensation is, in this case, included in the triggering of the whip roll 4.

FIGS. 12*a*, 12*b*, 12*c* and 12*d* show examples of pile height variations according to the invention. The pile height L can be triggered to be sawtoothed (145), wavy (146) or combined (147). Stepped (148) and gapped (149) floor patternings are other possibilities.

It would also be possible, for example, in the case of double fabric carpet looms, for high-pile cut velour zones to be combined as required with uncut low-pile zones.

The invention thus provides a method and a corresponding loom which effectively open up two new perspectives for terry weaving which conventional terry looms cannot provide, namely the free variation as required of terry rhythms and the variation as required of pile height. As described, this can also be automated.

What is claimed is:

1. A method of operating a terry loom having pile-forming elements and a main drive, said method comprising the steps directing at least one pile-forming element into a path of warp yarns to selectively form a pile in a cloth; and controlling the movement of the pile-forming element for individual picks independently of said main drive and in a selectively programmable manner to provide variable terry patterns.

2. A method as set forth in claim 1 wherein a separate drive from said main drive controls the movement of the pile-forming element, and which further includes the step of actuating said separate drive by a sequence of freely programmable pulses adapted to loom cycles and programmable with respect to at least one of terry rhythm, kind of terry, terry patterning and pile height to produce terry movements in said pile-forming element and equal tension in the warp yarns.

3. A terry loom comprising at least one pile-forming element for moving in a path of a warp yarn to form a loop in the warp yarn;

a servomotor;

a transmission coupling said servomotor to said element for selective movement of said element; and a circuit arrangement having a control connected to said servomotor for driving said servomotor in programmed manner to effect movement of said element and a control input connected to said control to deliver programmable signals to said control for selectively actuating said servomotor independently for individual picks.

4. A terry loom as set forth in claim 3 wherein said servomotor has a rotor of low mass movement of inertia and high field strength permanent magnets.

5. A terry loom as set forth in claim 4 wherein said magnets are rare earth magnets.

6. A terry loom as set forth in claim 4 wherein said magnets are made of Nd-Fe-B compounds.

7. A terry loom as set forth in claim 4 wherein said servomotor has a cooled stator.

8. A terry loom as set forth in claim 3 wherein said transmission means is a reduction transmission having a low inertia primary element connected to a shaft of said servomotor.

9. A terry loom as set forth in claim 3 which further comprises a main motor connected to said pile-forming element for driving said element in a basic movement, said servomotor being connected to said element to superimpose a controlled movement thereon.

10. A terry loom as set forth in claim 3 wherein said pile-forming element is a sley having a variable partial beat-up and said servomotor is connected to said sley to selectively vary movement thereof.

11. A terry loom as set forth in claim 3 wherein said pile-forming element includes a whip roll connected to said servomotor.

12. A terry loom as set forth in claim 3 wherein said pile-forming elements include a whip roll and a breast beam coupled to said whip roll and to said servomotor.

13. A terry loom as set forth in claim 3 which further comprises a pile warp length pick-up for sensing the length of a loop, said pick-up being connected to said circuit arrangement to deliver a signal indicative of a linear consumption of pile warp per pick for comparison with a set value signal.

14. A terry loom comprising a sley mounted for movement between a retracted position and a beat-up position;

a transmission connected with said sley for moving said sley between said positions, said transmission including an articulated lever movable into a deflected position to shorten the movement of said sley from said retracted position towards said beat-up position;

a servomotor;

a guide connected to said lever and coupled with said servomotor for movement between a pair of terminal positions, said guide being movable into one of said terminal positions to move said lever into said deflected position; and a control and circuit arrangement electrically connected to said servomotor for triggering said servomotor in a programmable manner to provide variable terry patterns.

15. A terry loom as set forth in claim 14 wherein said guide includes an arcuate slot and which further comprises a slide block slidably mounted in said slot and connected to an intermediate point of said articulated lever.

16. A terry loom comprising:

a sley mounted for movement between a retracted position an a beat-up position;

a transmission connected with said sley for moving said sley between said positions, said transmission including a cam, a rocker movable on said cam, a slide block articulated on said rocker and a pivotally mounted link secured to said sley and having a guide slidably receiving said block therein;

a servomotor coupled with said cam for movement between a pair of terminal positions to vary pivoting of said link; and a control and circuit arrangement electrically connected to said servomotor for triggering said servomotor in a programmable manner to provide variable terry patterns.

17. A terry loom as set forth in claim 16 wherein said cam includes a radial part for receiving said rocker with said sley in said retracted position and a non-radial part for receiving said rocker with said sley in a position spaced from said beat-up position.

18. A terry loom comprising:

a sley mounted for movement between a retracted position and a beat-up position;

a planetary transmission having a rotatable annulus defining a sun gear, a plurality of planetary gears in meshing relation with said sun gear, a carrier having said planetary gears rotatably mounted thereon and a sun wheel connected to said sley and disposed concentrically of said sun gear in meshing relation with said planetary gears; and a servomotor coupled with said carrier to selectively move said carrier relative to said sun wheel to vary the position of said sley from said retracted position.

19. A terry loom comprising a pile vibrator roll having a rotatably mounted top roll and a tube connected in parallel to said top roll for passage of pile warp yarns thereover;

a servomotor;

a transmission coupling said servomotor to said top roll for selectively rotating said top roll to vary the position of said tube; and a control and circuit arrangement electrically connected to said servomotor for triggering said servomotor in a programmable manner to provide variable terry patterns.

20. A terry loom as set forth in claim 19 which further comprises a spring biasing said top roll in a first direction and a damper for damping motion of said top roll in an opposite second direction.

21. A terry loom comprising:

a whip roll for passage of warp yarns thereover;

a first lever mounting said whip roll thereon;

a first servomotor connected to said lever for selectively pivoting said lever with said whip roll thereon;

a breast beam for passage of the warp yarns thereover;

a second lever mounting said breast beam thereon; and a second servomotor for selectively pivoting said second lever with said breast beam thereon.

22. A terry loom as set forth in claim 21 further comprising a first biasing spring connected to said first lever and a second biasing spring connected to said second lever in opposition to said first spring for biasing said whip roll and said breast beam away from each other.

23. A terry loom comprising a ground warp beam for supplying ground warp yarns into a shed;

a sley having a reed for movement within the shed to form a cloth of the warp yarns;

a main drive shaft;

a sley control for pivotally moving said sley between a retracted position and a full beat-up position;

a transmission connected between and to said drive shaft and said sley control for driving of said sley control from said main drive shaft to move said sley, said transmission having means for adjusting the movement of said sley from said retracted position towards said beat-up position;

a servomotor connected to said means in said transmission for selectively actuating said means to adjust the movement of said sley from said retracted position into a partial beat-up position spaced from said full beat up position; and a control and circuit arrangement electrically connected to said servomotor for triggering said servomotor in a programmable manner to provide variable terry patterns.

24. A terry loom as set forth in claim 23 wherein said servomotor has a low mass inertia rotor having high field strength permanent magnets.

25. A terry loom comprising a plurality of pile-forming elements including a whip roll for ground warp yarns and a breast beam for cloth;

a coupling element connecting said breast beam with said whip roll for simultaneous movement relative to a reed beating-up zone to vary the pile height in proportion thereto;

a servomotor connected to said coupling element for selectively moving said coupling element; and a control and circuit arrangement electrically connected to said servomotor for triggering said servomotor in a programmable manner to provide variable terry patterns.

* * * * *

UNITED STATES PATENT AND TRADEMARK OFFICE

CERTIFICATE OF CORRECTION

PATENT NO. : 5,058,628

DATED : October 22, 1991

INVENTOR(S) : Peter SPILLER, et al.

It is certified that error appears in the above-identified patent and that said Letters Patent is hereby corrected as shown below:

Col. 4, line 15, change "FIGS." to --FIG.--.

Col. 5, line 63, change "control ed" to --controlled--.

Col. 10, line 11, change "forces. can" to --forces can--.

In the Claims

Col. 13, line 68, change "a sley" to --a pile warp beam for supplying pile warp yarns into the shed; a sley--.

Signed and Sealed this

Twenty-first Day of September, 1993

Bruce Lehman

*Attest:*

BRUCE LEHMAN

*Attesting Officer*

*Commissioner of Patents and Trademarks*